US007096673B2

(12) United States Patent
Little et al.

(10) Patent No.: US 7,096,673 B2
(45) Date of Patent: Aug. 29, 2006

(54) BLADE TIP CLEARANCE CONTROL

(75) Inventors: David A. Little, Chuluota, FL (US); Gerry McQuiggan, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 345 days.

(21) Appl. No.: 10/681,397

(22) Filed: Oct. 8, 2003

(65) Prior Publication Data

US 2005/0076649 A1 Apr. 14, 2005

(51) Int. Cl.
*F02C 7/18* (2006.01)

(52) U.S. Cl. ..... 60/782; 785/806

(58) Field of Classification Search ..... 60/782, 60/785, 806; 415/178
See application file for complete search history.

(56) References Cited

U.S. PATENT DOCUMENTS

| | | | | |
|---|---|---|---|---|
| 4,127,988 | A | 12/1978 | Becker | |
| 4,257,222 | A * | 3/1981 | Schwarz | 60/782 |
| 4,503,683 | A | 3/1985 | Wieland et al. | |
| 5,163,285 | A | 11/1992 | Mazeaud et al. | |
| 5,317,877 | A | 6/1994 | Stuart | |
| 5,575,617 | A | 11/1996 | Marmilic et al. | |
| 5,678,408 | A | 10/1997 | Janes | |
| 6,250,061 | B1 | 6/2001 | Orlando | |
| 6,295,803 | B1 | 10/2001 | Bancalari | |
| 6,351,938 | B1 | 3/2002 | Kerrebrock | |
| 6,382,903 | B1 | 5/2002 | Caruso et al. | |
| 6,401,460 | B1 | 6/2002 | Xia | |
| 6,612,114 | B1 * | 9/2003 | Klingels | 60/785 |

FOREIGN PATENT DOCUMENTS

| | | | |
|---|---|---|---|
| EP | 0735255 | A1 | 10/1996 |
| EP | 1074694 | A2 | 2/2001 |
| JP | 2000291447 | A2 | 10/2000 |
| JP | 2000310127 | A2 | 11/2000 |
| JP | 2001065367 | A2 | 3/2001 |

OTHER PUBLICATIONS

Pratt & Whitney Aircraft Group. The Aircraft gas Turbine Engine And Its Operation. United Technologies, 1980. pp. 219-220.*

* cited by examiner

*Primary Examiner*—Louis J. Casaregola

(57) ABSTRACT

Aspects of the invention relate to methods and assemblies for improving the efficiency of a turbine engine through active management of blade tip clearances. In some designs, a portion of compressor exit air is routed to the rotor and discs of the turbine section. Aspects of the invention relate to treating the compressor exit air in light of the operating conditions of the engine. For instance, under base load or substantially steady state operation, a portion of compressor exit air can be routed to the rotor and discs without reducing the temperature of the compressor exit air. In such case, blade tip clearances will reduce, allowing for improved engine efficiency. Under part load or substantially transient operating conditions, a portion of compressor exit air can be cooled before it is supplied to the rotor and discs. As a result, the blade tip clearances increase, minimizing concerns of blade tip rubbing. Routing of the compressor exit air for cooling and bypass can be controlled by a valve.

19 Claims, 2 Drawing Sheets

BLADE TIP CLEARANCE CONTROL

FIELD OF THE INVENTION

The invention relates in general to turbine engines and, more particularly, to an engine assembly and an associated method for optimizing engine efficiency by reducing blade tip clearances.

BACKGROUND OF THE INVENTION

Turbine engines commonly operate at efficiencies ranging from about 30% to about 40%. The operational efficiency is less than the theoretical maximum because of losses that occur in the flow path. One of the major flow path losses is due to the leakage of hot combustion gases across the tips of the turbine blades. In particular, the leakage occurs across a space between the tips of the rotating turbine blades and the surrounding stationary structure such as the ring segments. This spacing is often referred to as the blade tip clearance.

Blade tip clearances cannot be eliminated because, during transient conditions such as during engine startup or part load operation, the rotating parts (blades, rotor, and discs) and stationary parts (outer casing, blade rings, and ring segments) thermally expand at different rates. As a result, blade tip clearances can actually decrease during engine startup until steady state operation is achieved at which point the clearances can increase, thereby reducing the efficiency of the engine. Thus, there is a need for controlling blade tip clearances in order to maximize the efficiency of a turbine engine.

SUMMARY OF THE INVENTION

Thus, one object according to aspects of the present invention is to provide a method for actively controlling blade tip clearances. Another object according to aspects of the invention is to provide a turbine engine assembly configured to actively manage blade tip clearances under various operating conditions. Still another object according to aspects of the invention is to reduce blade tip clearances and the losses occurring over the blade tips at substantially steady state or full power operation of the turbine so as to improve engine performance. A further object according to aspects of the invention is to increase blade tip clearances during substantially transient engine operation such as at startup. These and other objects according to aspects of the present invention are addressed below.

In one respect, aspects of the invention relate to a method for increasing the efficiency of a turbine engine by controlling blade tip clearances. The method includes operating a turbine engine under substantially steady state conditions, which can include base load operation of the turbine engine. The turbine engine has at least a compressor section and a turbine section. The turbine section includes a rotor with discs on which a plurality of blades are attached.

Air exiting the compressor section at a compressor exit temperature is provided. In one embodiment, the compressor exit temperature can be about 450 degrees Celsius. At least a portion of the air exiting the compressor section is routed to the rotor and discs of the turbine section without substantially reducing the temperature of the air portion from the compressor exit temperature as it is presented to the rotor and discs. As a result, blade clearances, defined between the tips of the blades and the neighboring ring segments, are minimized due to the thermal expansion of the rotor and discs.

Aspects according to the invention relate to another method for increasing the efficiency of a turbine engine by controlling blade tip clearances. The method includes operating a turbine engine. The turbine engine has at least a compressor section and a turbine section. The turbine section includes a rotor with discs on which a plurality of blades are attached. Air exiting the compressor section at a compressor exit temperature is provided. The compressor exit temperature can be about 450 degrees Celsius.

When the turbine engine operates under substantially transient conditions, at least a first portion of air exiting the compressor section is substantially exclusively routed to a cooling path. Substantially steady state conditions can include base load operation of the turbine engine. The cooling path can include at least one heat exchanger. In the cooling path, the first portion of air is cooled to a cooling temperature that is less than the compressor exit temperature. The first portion of air substantially at the cooling temperature is supplied to the rotor and discs. The cooling temperature is less than the temperature of the rotor and discs. In one embodiment, the cooling temperature can be about 150 degrees Celsius. Thus, clearances between the tips of the blades and the neighboring stationary blade ring increase due to contraction of the rotor and discs.

When the turbine engine operates under substantially steady state conditions, at least a second portion of the air exiting the compressor section is substantially exclusively routed to a bypass path. Substantially transient conditions can include part load operation of the turbine engine or they can include start up of the turbine engine. The temperature of the second portion of air exiting the bypass path is substantially unchanged from the compressor exit temperature. The second portion of air is supplied to the rotor and discs. The temperature of the second portion of air is greater than the cooling temperature. Thus, a clearance between the tips of the blades and the neighboring stationary blade ring decreases as a result of the thermal expansion of the rotor and discs in response to being exposed to the relatively higher temperature of the second portion of air.

The previous steps can be repeated as necessary during engine operation so as to maintain adequate blade tip clearances. The first and second portions of compressor exit air can be substantially exclusively routed to one of the cooling path or the bypass path by a valve.

In other respects, aspects of the invention can relate to a turbine engine assembly. The assembly includes a turbine engine having at least a compressor section and a turbine section. The turbine section includes a rotor with discs on which a plurality of blades are attached. The assembly further includes a compressor exit air treatment circuit that receives at least portion of air exiting the compressor section and routes the at least portions of air to the turbine section for presentation to at least the rotor and discs.

The compressor exit air treatment circuit includes a valve, a bypass path and a cooling path. The valve is selectively operable between a first position and a second position. In the first position, at least a first portion of compressor exit air at a compressor exit temperature is routed substantially exclusively to the bypass path. In the second position, at least a second portion of compressor exit air at the compressor exit temperature is routed substantially exclusively to the cooling path. The valve can be selectively positioned in the first position when the turbine is operating substantially at base load. The valve can be selectively positioned in the second position when the turbine is operating under one of part load or engine startup conditions.

The cooling path includes at least one heat exchanger. The temperature of the second portion of compressor exit air is cooled to a cooling temperature substantially less than the compressor exit temperature after passing through the cooling path. The cooling temperature can be about 150 degrees Celsius. The temperature of the first portion of compressor exit air is substantially unchanged from the compressor exit temperature through the bypass path. The compressor exit temperature can be about 450 degrees Celsius.

DETAILED DESCRIPTION OF EMBODIMENTS OF THE INVENTION

Aspects of the present invention generally relate to improving the efficiency of turbine engines. More particularly, aspects of the invention relate to the active management of blade tip clearances at various instances during the operation of a turbine engine. Aspects of the invention are described in connection with turbine engine assemblies and methods of operating such turbine engines.

Figure 1:
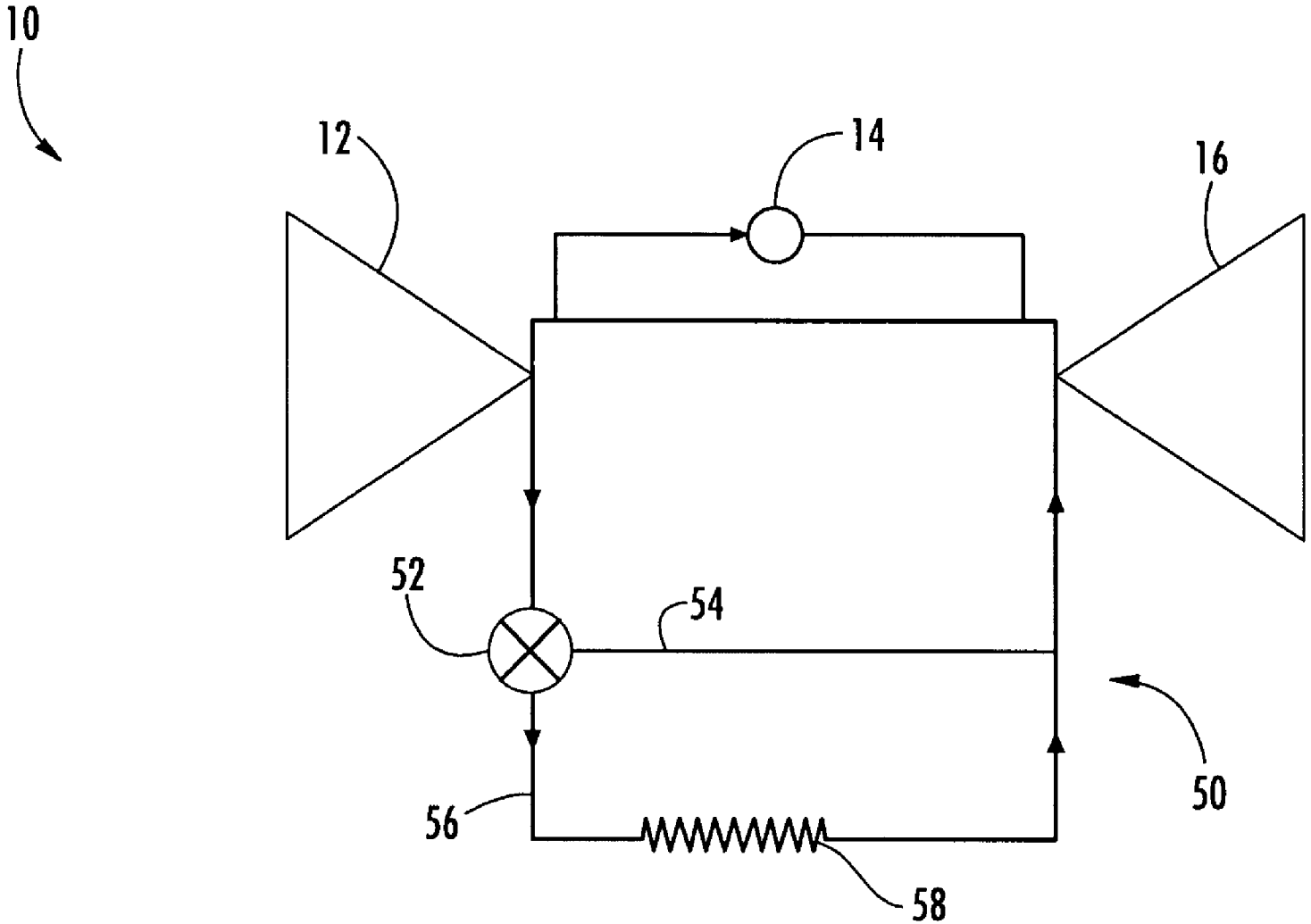
FIG. 1 is a schematic diagram of a turbine engine configured according to aspects of the present invention.
Figure 2:
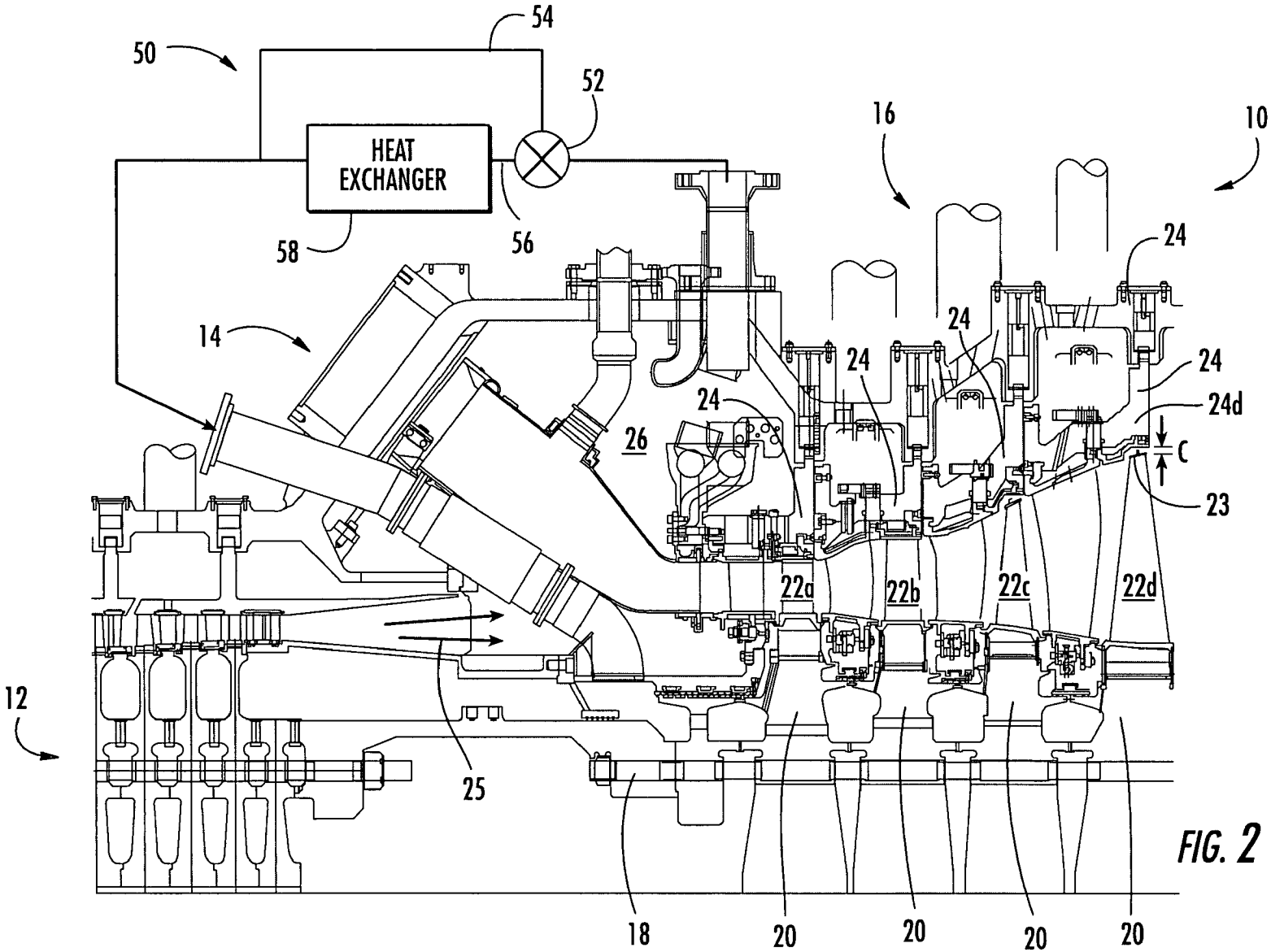
FIG. 2 is a cross-sectional view, partly schematic, of a turbine engine configured according to aspects of the present invention.

Embodiments according to aspects of the invention are shown in FIGS. 1–2, but the present invention is not limited to the illustrated structure or application. Further, the following detailed description is intended only as exemplary.

Aspects of the invention can be applied to a variety of turbine engine systems. In basic form, a turbine engine 10 can generally include a compressor section 12, a combustor section 14 and a turbine section 16 (FIG. 1). Each of these sections can have a variety of components and configurations. As shown in FIG. 2, the turbine section 16 can include a rotor 18 with discs 20 on which a plurality of blades 22*a*,22*b*,22*c*,22*d* (collectively referred to as 22) are attached. Surrounding these components are a variety of stationary support structures 24 such as an outer casing, blade rings and ring segments. The space between the tips 23 of the blades 22 and the neighboring stationary support structure 24 is known as the blade tip clearance C. The blade tip clearance C is shown in FIG. 2 between the fourth row of blades 22*d* and the fourth blade ring 24*d;* similar clearances are present between the first 22*a,* second 22*b* and third 22*c* rows of blades and the adjacent stationary support structure 24.

In basic operation, ambient air can enter the compressor section 12 where the air is compressed, resulting in an increase in the temperature of the air exiting the compressor section 12. For example, in one turbine engine, the temperature of the compressor exit air can be about 450 degrees Celsius. After leaving the compressor section 12, the compressor exit air 25 generally flows into the combustor shell 26, from which the air can be supplied to other areas of the turbine engine such has the combustion section 14 and turbine section 16. It should be noted that air in the combustor shell 26 can sometimes be referred to as shell air, but, for purposes of this disclosure, it will be referred to as compressor exit air. Any difference in temperature between the air immediately exiting the compressor 12 and the air in the combustor shell 26 is negligible for purposes of this disclosure.

A large portion of the compressor exit air 26 can be directed to the combustor section 14 of the engine 10. However, portions of the compressor exit air can also be diverted for use in other areas. For example, in some turbine engine designs, a portion of the compressor exit air 25 can be bled from the combustor shell 26 and used to cool at least the turbine rotor 18, discs 20, and blades 22 (FIG. 2).

Aspects according to the present invention relate to a turbine engine assembly configured to allow greater flexibility and control in managing turbine blade tip clearances. In addition to having at least some of the attributes discussed above, a turbine engine assembly 10 according to aspects of the invention can further include a compressor exit air treatment circuit 50 including a valve 52, a bypass path 54 and a cooling path 56. In one case, the valve 52 can be selectively operated between a first position in which a first portion of compressor exit air is routed substantially exclusively to the bypass path 54, and a second position in which a second portion of compressor exit air is routed substantially exclusively to the cooling path 56 and vice versa. Substantially exclusively routing means that a portion of compressor exit air is diverted to, for example, the bypass path 54 with little or no compressor exit air entering the cooling path 56. The terms first portion and second portion are used in connection with a portion of air exiting the compressor to facilitate discussion and are not intended to limit the scope of the invention or to necessarily specify any order.

In one embodiment, the valve 52 can be selectively positioned in the first position when the turbine engine 10 is operating under substantially steady state conditions including when the engine is operating at or substantially near base load. Substantially steady state conditions can encompass those situations in which thermal expansion of the components that establish the blade tip clearance C, such as the blades 22 and the blade ring, has substantially stabilized or those situations in which at least the stationary components 24 have expanded to their steady state shapes. The valve 52 can be selectively positioned in the second position, for example, when the turbine engine 10 is operating under transient conditions such as during part load, engine startup or otherwise in instances in which thermal expansion of the components that define the blade tip clearance, such as the blades 22 and the blade ring, has not substantially stabilized.

The valve 52 can be switched from the first position to the second position manually or by an engine controller. An engine controller can selectively switch the valve based on monitoring input as to the operating condition of the turbine engine.

The cooling path 56 can cool the temperature of at least a first portion of compressor exit air to a cooling temperature. In other words, the temperature of the first portion of compressor exit air can be lower when it exits the cooling path 56 compared to when it entered the cooling path 56. For example, the temperature of the first portion of compressor exit air entering the cooling path can be about 450 degrees Celsius, but, after passing through the cooling path 56, the temperature of the first portion of compressor exit air can be about 150 degrees Celsius. The cooling path 56 can include one or more heat exchangers 58 to cool the first portion of compressor exit air before it is supplied to the rotor 18 and discs 20. The heat exchanger 58 can be external to the turbine engine 10 itself.

The bypass path 54 can be constructed as a duct that extracts at least a second portion of compressor exit air out of the combustor shell 26 and routes the compressor exit air portion to the rotor 18 and discs 20 of the turbine section 16. While traveling through the bypass path 54, the temperature of the second portion of compressor exit air is substantially unchanged. That is, there is minimal or no variation in the temperature of the portion of compressor exit air as it is taken from the combustor shell 26 and the temperature of the portion of compressor exit air as it exits the bypass path 54. In one embodiment, the temperature of the compressor exit air remains at about 450 degrees Celsius through the bypass path.

A turbine engine 10, configured as described above or otherwise, can be used in methods according to aspects of the invention so as to improve the efficiency of a turbine engine 10 by controlling blade tip clearances C. The methods described are merely examples as not every step described need occur and, similarly, the steps described are not limited to being performed in the sequence described.

In one method, a turbine engine 10 can be operated under substantially steady state conditions. Substantially steady state conditions can include, for example, base load operation as well as part load operation in which most of the stationary components of the engine have thermally expanded to their steady state shapes. Once the engine is operating at steady state conditions, at least a portion of the air exiting the compressor section can be routed to the rotor and discs of the turbine section. During such routing, the temperature of the compressor exit air is not substantially reduced in comparison to the temperature of the air as it exits the compressor, such as about 450 degrees Celsius. As a result of the exposure to the higher temperature air, the blade clearances decrease due to the thermal expansion of the rotor and discs.

Another method according to aspects of the invention is described below. Under such a method, at least a portion of compressor exit air can be treated depending on the operating conditions of the engine. For example, when the turbine engine operates under substantially transient conditions, a first portion of air exiting the compressor section can be substantially exclusively routed to a cooling path. The cooling path includes at least one heat exchanger.

In the cooling path, the first portion of compressor exit air, which can be about 450 degrees Celsius, can be cooled to a cooling temperature, such as about 150 degrees Celsius, before the first portion of air is supplied to the rotor and discs. The cooling temperature is less than the temperature of the rotor and discs; consequently, the rotor and discs will contract due to exposure to the cooler air. Thus, during engine startup or during part load operation or other substantially transient conditions, relatively large blade clearances are maintained between the tips of the blades and the neighboring stationary ring segments so as to prevent tip rubbing.

When the turbine engine operation reaches substantially steady state conditions, at least a second portion of the air exiting the compressor section can be substantially exclusively routed to a bypass path before being supplied to the rotor and discs of the turbine section. The temperature of the second portion of air is substantially unchanged as it passes through the bypass portion. In other words, the cooling path can be bypassed so that the rotor and discs can be exposed to the full temperature, about 450 degrees Celsius, of the compressor exit air. Therefore, upon exposure to the second portion of compressor exit air, the rotor and discs tend to thermally expand, reducing the blade tip clearances. Preferably, the blade tip clearances are reduced so as to be as minimal as possible, but generally not less than about 1.0 millimeter. The efficiency of the engine will increase because with less leakage occurs across the blade tips.

The compressor exit air portion routed through the bypass circuit to the rotor and discs may vary to some degree from the precise temperature at the compressor exit due to ambient conditions in the routing from the compressor section to the turbine section. However, the variations are not substantial, and reference to the temperature of compressor exit air portion routed through the bypass circuit being unchanged relative to the compressor exit temperature is intended to connote that this compressor exit air portion is not treated by heat exchangers or other intended temperature adjusting equipment.

It should be noted that, when presented to the rotor 18 and discs 20, the temperature of the air supplied to rotor 18 and discs 20, whether it is at the cooling temperature or substantially at the compressor exit temperature, is less than the metal temperature of the rotor 18 and discs 20. Thus, the compressor exit air, regardless of how it is treated according to aspects of the invention, acts as a heat sink to cool the rotor 18 and discs 20. Nevertheless, as will be explained below, thermal expansion of the rotor 18 and discs 20 occurs when the compressor exit air from the bypass path 54 is supplied to the rotor 18 and discs 20.

The temperature of the rotor 18, discs 20 and blades 22 is naturally dependent on the environment in which these components operate. For example, the temperature of each of these components is affected by the temperature of the combustion gases passing through the turbine section 16 of the engine 10. The temperature of the combustion gases can be, for example, from about 1000 degrees Fahrenheit to about 2800 degrees Fahrenheit. While the combustion gas flow directly contacts the blades 22, the heat from combustion gases can flow into the area around the rotor 18 and discs 20, thereby affecting the temperature of the rotor 18 and discs 20. Exposure to these superheated gases would normally cause the discs 18 and rotor 20 to thermally expand from their ambient state.

However, the tendency to thermally expand is counteracted by the air supplied to the rotor 18 and discs 20 according to aspects of the invention. From engine startup until substantially steady state conditions are achieved, air at the cooling temperature, about 150 degrees Celsius, is supplied to the rotor 18 and discs 20. After prolonged exposure to these competing temperatures, the rotor 18 and discs 20 will eventually reach an equilibrium temperature, which will be somewhere between the cooling temperature and the temperature of the combustion gases.

This state of thermal equilibrium is disturbed when the engine 10 reaches substantially steady state conditions, for, at that point, the compressor exit air 25 is substantially exclusively routed to the bypass path 54. Thus, the temperature of the air supplied to the rotor 18 and discs 20 increases to, for example, about 450 degrees Celsius. Further, at base load, the temperature of the combustion gases flowing through the turbine section 16 can increase as well. In light of these temperature increases, the equilibrium temperature of the rotor 18 and discs 20 shifts to a higher temperature. As a result of the increase in their equilibrium temperatures, the rotor 18, discs 20 and blades 22 will thermally expand. Thus, thermal expansion is the response to at least the hotter supply air from the bypass path 54. During unloading, the compressor exit air can be routed through the cooling path 56 to contract the rotor 18 and discs 20 and reopen the blade tip clearances C.

The steps described above can be repeated as necessary during engine operation so that adequate transient blade tip clearances C can be maintained. Further, the first and second portions of compressor exit air can be substantially exclusively routed to one of the cooling path 56 or the bypass path 54 by a valve 52.

It will of course be understood that the invention is not limited to the specific details described herein, which are given by way of example only, and that various modifications and alterations are possible within the scope of the invention as defined in the following claims.

What is claimed is:

1. A method for increasing the efficiency of a turbine engine by controlling blade rip clearances comprising the steps of:

operating a turbine engine under a substantially steady state condition and under a transient condition, the turbine engine having at least a compressor section and a turbine section, the turbine section including a rotor with discs on which a plurality of blades are attached;

providing air exiting the compressor section at a compressor exit temperature;

selectively routing at least a portion of the air exiting the compressor section to the rotor and discs of the turbine section without substantially reducing the temperature of the air portion from the compressor exit temperature as it is presented to the rotor and discs, wherein the selectively routing step is performed during the substantially steady state condition, wherein the selectively routing step is not performed during the transient condition, whereby blade clearances, defined between the tips of the blades and the neighboring ring segments, are minimized due to the thermal expansion of the rotor and discs.

2. The method of claim 1 wherein the compressor exit temperature is about 450 degrees Celsius.

3. The method of claim 1 wherein the substantially steady state condition includes base load operation of the turbine engine.

4. A method for increasing the efficiency of a turbine engine by controlling blade tip clearances comprising the steps of:

(a) operating a turbine engine, the turbine engine having at least a compressor section and a turbine section, the turbine section including a rotor with discs on which a plurality of blades are attached;

(b) providing air exiting the compressor section at a compressor exit temperature;

(c) when the turbine engine operates under substantially transient conditions, substantially exclusively routing at least a first portion of air exiting the compressor section to a cooling path, wherein the first portion of air is cooled to a cooling temperature that is less than the compressor exit temperature;

(d) supplying the first portion of air substantially at the cooling temperature to the rotor and discs, wherein the cooling temperature is less than the temperature of the rotor and discs, whereby clearances between the tips of the blades and the neighboring stationary blade ring increase as a result of the contraction of the rotor and discs;

(e) when the turbine engine operates under substantially steady state conditions, substantially exclusively routing a second portion of the air exiting the compressor section to a bypass path, wherein the temperature of the second portion of air exiting the bypass path is substantially unchanged from the compressor exit temperature; and (f) supplying the second portion of air to the rotor and discs, wherein the temperature of the second portion of air is greater than the cooling temperature, whereby a clearance between the tips of the blades and the neighboring stationary blade ring decreases as a result of the thermal expansion of the rotor and discs in response to being exposed to the relatively higher temperature of the second portion of air.

5. The method of claim of claim 4 further including the step of repeating steps (b)–(f) as necessary during engine operation, whereby adequate blade tip clearances are maintained.

6. The method of claim of claim 4 wherein the cooling path includes at least one heat exchanger.

7. The method of claim 4 wherein the cooling temperature is about 150 degrees Celsius.

8. The method of claim 4 wherein the compressor exit temperature is about 450 degrees Celsius.

9. The method of claim 4 wherein substantially steady state conditions include base load operation of the turbine engine.

10. The method of claim 4 wherein substantially transient conditions include part load operation of the turbine engine.

11. The method of claim 4 wherein substantially transient conditions include engine start up of the turbine engine.

12. The method of claim 4 wherein the first and second portions of compressor exit air are substantially exclusively routed to one of the cooling path or the bypass path by a valve.

13. A turbine engine assembly comprising:

a turbine engine having at least a compressor section and a turbine section, the turbine section including a rotor with discs on which a plurality of blades are attached;

a compressor exit air treatment circuit receiving at least portion of air exiting the compressor section and rowing the at least portions of air to the turbine section for presentation to at least the rotor and discs, the compressor exit air treatment circuit including a valve, a bypass path and a cooling path the valve being selectively operable between a first position, wherein at least a first portion of compressor exit air at a compressor exit temperature is routed substantially exclusively to the bypass path, and a second position, wherein at least a second portion of compressor exit air at the compressor exit temperature is routed substantially exclusively to the cooling path; and the cooling path including at least one heat exchanger wherein the temperature of the second portion of compressor exit air is cooled to a cooling temperature substantially less than the compressor exit temperature after passing through the cooling path and wherein the temperature of the lint portion of compressor exit air is substantially unchanged from the compressor exit temperature through the bypass path.

14. The turbine engine assembly of claim 13 wherein the valve is selectively positioned in the first position when the turbine is operating substantially at base load.

15. The turbine engine assembly of claim 13 wherein The valve is selectively positioned in the second position when the turbine is operating under one of part load or engine startup conditions.

16. The turbine engine assembly of claim 13 wherein the cooling temperature is about 150 degrees Celsius.

17. The turbine engine assembly of claim 13 wherein the compressor exit temperature is about 450 degrees Celsius.

18. The method of claim 1 wherein the transient condition includes part load operation of the turbine engine.

19. The method of claim 1 wherein the transient condition includes start up of the turbine engine.

* * * * *